US005523777A

United States Patent [19]

Kitamura

[11] Patent Number: 5,523,777

[45] Date of Patent: Jun. 4, 1996

[54] APERTURE ELECTRODE WITH OVERLYING CHARGE MEMBER

[75] Inventor: Tetsuya Kitamura, Gifu, Japan

[73] Assignee: Brother Kogyo Kabushiki Kaisha, Nagoya, Japan

[21] Appl. No.: 214,633

[22] Filed: Mar. 18, 1994

[30] Foreign Application Priority Data

May 10, 1993 [JP] Japan ..... 5-108374
May 10, 1993 [JP] Japan ..... 5-108375

[51] Int. Cl.[6] ..... B41J 2/385; B41J 2/415

[52] U.S. Cl. ..... 347/55; 347/151

[58] Field of Search ..... 347/55, 124, 151

[56] References Cited

U.S. PATENT DOCUMENTS 3,689,935 9/1972 Pressman et al. ..... 347/55
4,912,489 3/1990 Schmidlin ..... 347/55
5,036,341 7/1991 Larsson ..... 347/55
5,200,769 4/1993 Takemura et al. ..... 347/55

FOREIGN PATENT DOCUMENTS 0463743 1/1992 European Pat. Off. .
4-142952 5/1992 Japan ..... 347/55
4191780 10/1992 Japan .

*Primary Examiner*—Joan H. Pendegrass
*Attorney, Agent, or Firm*—Oliff & Berridge

[57] ABSTRACT

An insulating layer of an aperture electrode provided in a recording apparatus is formed of polyimide which is liable to be negatively electrified through frictional contact with toner when the toner is negatively chargeable. Further, a charge member which can be charged in the same polarity as the toner is placed on the aperture electrode so as to surround the opening portions of the aperture electrode. With this structure, a recording operation of high image quality can be performed using a low voltage while preventing the deposition of the toner at the control electrodes of the aperture electrode so that the recording operation can be stably performed at all times.

8 Claims, 7 Drawing Sheets

APERTURE ELECTRODE WITH OVERLYING CHARGE MEMBER

BACKGROUND OF THE INVENTION

1. Field of the Invention

This invention relates to a recording apparatus for use in a copying machine, a printer, a facsimile machine, and similar machines.

2. Description of Related Art

A conventionally known an image forming apparatus is disclosed in U.S. Patent No. 3,689,935 which uses an electrode having plural opening portions (hereinafter referred to as "apertures") formed therein. In this image forming apparatus, a voltage is applied to the electrode on the basis of an image data to control the passage of toner particles through the apertures, and an image (toner image) is formed on a supporter by means of the passed toner particles.

This image forming apparatus includes an aperture electrode member comprising an insulating flat plate, a reference electrode having a continuous body formed on one surface of the flat plate, plural control electrodes which are insulated from one another and formed on the other surface of the flat plate, and at least one array (row) of apertures each of which is formed in correspondence with a control electrode so as to penetrate through the flat plate, the reference electrode and the control electrode.

The image forming apparatus further includes means for selectively applying a potential across the reference electrode and each of the control electrodes, means for supplying charged toner particles so that the flow of the toner particles passed through the apertures is modulated on the basis of the applied potential, and means for positioning the supporter in a particle-flow passage so that the supporter and the aperture electrode member are relatively movable.

In the conventional recording apparatus as described above, the toner which has passed through the opening portions of the toner flow control means does not entirely fly toward a back electrode and a part of the toner is attached to the surface of the control electrodes. The attachment of the toner to the control electrodes disturbs the smooth flight of the toner passing through the opening portions toward the back electrode. In addition, there occurs a problem that the opening portions become clogged with toner.

Further, the toner is attached to the reference electrode side of the aperture electrode member. The attachment of the toner to the reference electrode prevents the toner from properly passing through the opening portions and it causes fog. It finally causes a problem that the opening portions are clogged with the toner.

SUMMARY OF THE INVENTION

A copending U.S. patent application proposes an aperture electrode member comprising an insulating sheet having opening portions formed therein and control electrodes which are formed at the peripheral portions of the opening portions. In this application, a toner supply device includes a toner carrier for carrying toner thereon. The toner carrier is disposed in contact with the insulating sheet side of the aperture electrode member, so that the toner is supplied from the toner carrier to the opening portions of the aperture electrode. In this structure, a toner flow control voltage is applied to the control electrodes of the aperture electrode member to generate a toner flow control electric field in a gap between the toner carrier and the control electrodes of the aperture electrode member and Coulomb's force, due to the toner flow control electric field, is applied to the toner which is supplied to the opening portions of the aperture electrode, thereby controlling the passage of the toner through the opening portions.

However, even in this type of recording apparatus, the charged toner does not entirely fly toward the back electrode, and there still remains the problem that the toner is attached to the surface of the control electrodes. Further, since the charged toner is supplied to the aperture electrode while pressed against the insulating sheet of the aperture electrode member, the charged toner is attached to the insulating sheet. Thus, the gap interval between the toner carrier and each of the control electrodes of the aperture electrode member is increased by the length corresponding to the thickness of a toner layer formed of the attached toner so that the toner flow control electric field is lowered. As a result, the control performance of the toner flow is deteriorated so that the recording density is reduced and the fog becomes more pronounced.

An object of the invention is to provide a recording apparatus having means for preventing deposition of toner on the toner flow control means and capable of achieving a stable recording at all times.

In order to attain the above object, a recording apparatus of the invention comprises an insulating sheet having opening portions, toner flow control means for controlling passage of charged toner through the opening portions, toner supply means for supplying the charged toner to the toner flow control means and a back electrode disposed so as to confront the toner flow control means, wherein a surface of the insulating sheet facing the toner supply means is formed by a material which is charged with the same polarity as the charged toner.

As is apparent from the above description, according to the recording apparatus of the invention, the insulating sheet is charged with the same polarity as the supplied charged toner so that the toner and the insulating sheet are repulsed from each other. Accordingly, the toner is prevented from being attached onto the insulating sheet and the toner flow can be controlled with a low control voltage. Further, the deposition of the toner in the toner flow control means can be prevented so that a stable recording operation can be attained at all times.

BRIEF DESCRIPTION OF THE DRAWINGS

Preferred embodiments of the invention will be described in detail with reference to the following figures in which.

DETAILED DESCRIPTION OF THE PREFERRED EMBODIMENT

A preferred embodiment according to the invention will be described hereunder with reference to the accompanying drawings.

Figure 1:
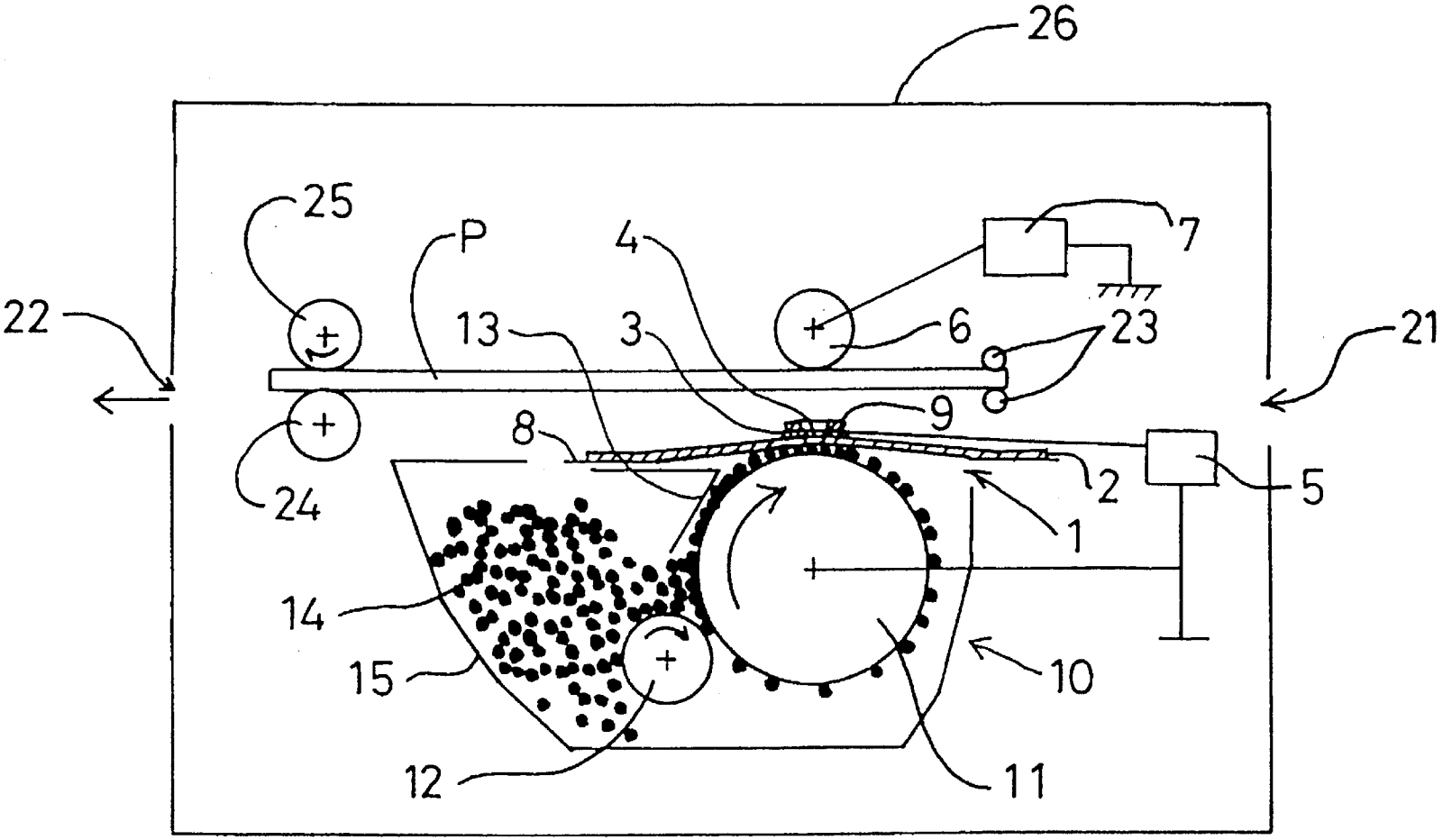
FIG. 1 is a schematic view showing the structure of a recording apparatus of the embodiment.

FIG. 1 shows the structure of a recording apparatus of the preferred embodiment. An insertion port 21 for inserting therethrough a printing medium P on which an image will be recorded is provided at the right side of a housing 26 of the apparatus. A take-out port 22, through which an image-recorded printing medium P is discharged, is provided at the left side of the housing 26. Further, an aperture electrode 1 serving as toner flow control means, a back electrode 6 and a toner supply apparatus 10 are provided inside of the apparatus.

Figure 2:
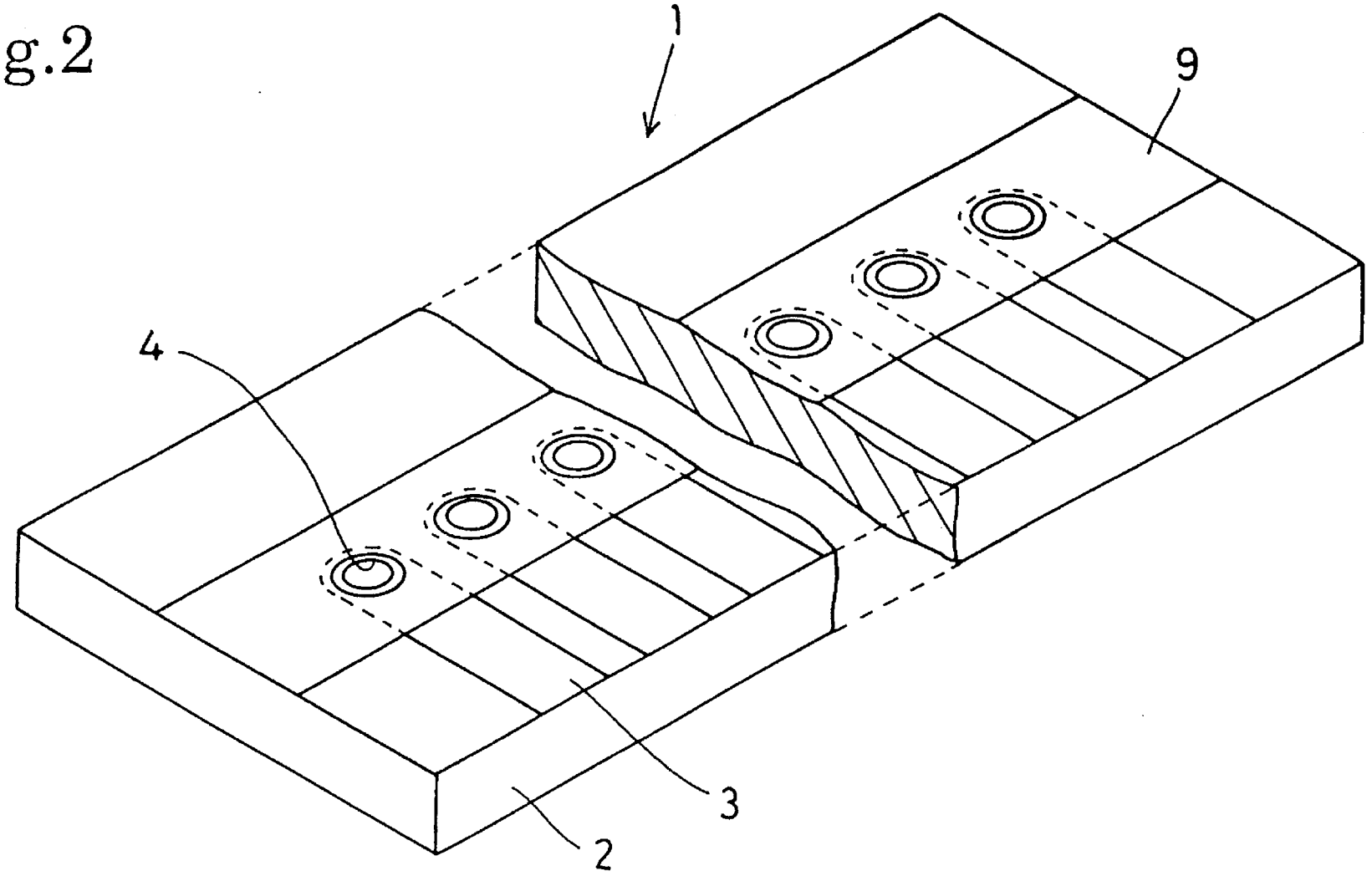
FIG. 2 is a perspective view showing an aperture electrode in the recording apparatus shown in FIG. 1.

As shown in detail in FIG. 2, the aperture electrode 1 comprises a flat-shaped insulating sheet 2 of insulating material as described later. A plurality of opening portions 4 are formed in the insulating sheet 2 so as to be aligned in a row at an equi-interval along the longitudinal direction of the sheet 2. A number of control electrodes 3 are provided on the upper surface of the insulating sheet 2 in such a manner as to individually surround each of the opening portions 4. The insulating sheet 2 comprises a high polymer resin film of 12.5 μm thickness, and is formed of polyimide, for example. The control electrodes 3 are formed of metal film of 1 μm thickness, for example, formed of copper by a sputtering method. Each of the opening portions 4 is a through hole of 60 μm in diameter. Each control electrode 3 is connected to a control voltage applying circuit 5 (FIG. 1).

Toner which is negatively charged is used in this embodiment as will also be described later. Thus, CAPTON™, which is sold by TORE-DUPONT and is liable to be negatively charged through contact or friction with the toner, is used as the polyimide constituting the insulating sheet 2.

A charge member 9, which is charged in the same polarity as the charged toner, is adhesively attached on the insulating sheet 2 so as to surround the opening portions 4. In this embodiment, the charge member 9 is formed of polyimide sold by TORE-DUPONT, that is, polyimide sold under the trade name CAPTON™ is used for the charge member 9. CAPTON™ has been experimentally confirmed to be more easily charged in the same polarity (negatively) as the charged toner as will be described later and has the chemical formula of

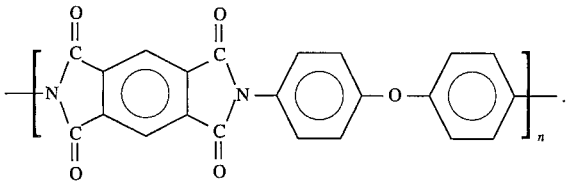

The aperture electrode 1 is supported by a stand 8 mounted on a chassis (not shown) in the apparatus. The toner supply device 10 is disposed below the aperture electrode 1. The toner supply device 10 is covered by a toner case 15 and comprises a toner carry roller 11, a supply roller 12 and a blade 13. Further, toner 14 is accommodated inside of the toner case 15. The supply roller 12 is designed to be rotatable in the direction indicated by an arrow in FIG. 1 to supply the toner 14 to the toner carry roller 11. The blade 13 is disposed so as to contact the toner carry roller 11 under pressure. The toner carry roller 11 is disposed to be in contact with at least all of the opening portions 4 of the aperture electrode 1.

A back electrode 6 is disposed above the aperture electrode 1. A gap of 0.5 mm interval is provided between the back electrode 6 and the aperture electrode 1 so that a printing medium P can be passed through the gap. The back electrode 6 is supplied with a voltage of +1.5 kV by a power source 7. In this embodiment, the gap interval between the back electrode 6 and the aperture electrode 1 and the voltage to be applied to the back electrode 6 are set to obtain a reference value of 300 V/0.1 mm.

The printing medium P is fed to the lower side of the back electrode 6 from the insertion port 21 by a pair of guide rollers 23. After passing over the back electrode 6, the printing medium P is fed to a gap between a heat roller 24, having a heat source therein, and a press roller 25 to fix the toner onto the printing medium with heat.

Next, the operation of the recording apparatus thus structured will be described.

First, the toner 14, held in the toner case 15 of the toner supply device 10, is fed to the toner carry roller 11 by the supply roller 12. At this time, the particles of the toner 14 are contacted with each other under friction by the contact between the supply roller 12 and the toner carry roller 11 and are negatively charged. The charged toner 14 is fed to the opening portions 4 of the aperture electrode 1 past the blade 13 through rotation of the toner carry roller 11. The toner 14 which has been carried on the toner carry roller 11 is smoothed by the blade 13 to form a thin toner layer having uniform thickness, and then supplied to the opening portions 4 of the aperture electrode 1.

A voltage is applied from the control voltage applying circuit 5 to appropriate ones of the control electrodes 3 in accordance with an image signal. In accordance with this applied voltage, the negatively charged toner 14, which has been supplied to the opening portions 4 of the aperture electrode 1, is controlled in its passage through the opening portions 4 of the control electrodes 3.

Describing in detail, when a voltage of +30 V is applied as a toner pass voltage from the control voltage applying circuit 5 to the control electrodes 3, an electric field with which the negatively charged toner 14 can be passed through the opening portions 4 occurs between the grounded toner carry roller 11 and the charged control electrodes 3, that is, inside of the opening portions 4 of the control electrodes which are supplied with the voltage. Coulomb's force (attractive force) is applied to the charged toner 14 due to the electric field, and the charged toner 14 is accelerated by Coulomb's force and passes through the opening portions 4.

Further, when a voltage of −10 V is applied as a toner shield voltage from the control voltage applying circuit 5 to the control electrodes 3, an electric field is created, which prevents the negatively charged toner 14 from passing through the opening portions 4, between the grounded toner carry roller 11 and the control electrodes 3, that is, the inside of the opening portions 4. At these openings a repulsive Coulomb's force is applied to the charged toner 14 due to the electric field and the charged toner 14 is prevented from passing through the opening portions 4 by the Coulomb's force.

Further, the aperture electrode 1 and the negatively-charged toner 14 are electrostatically repulsed from each other at the contact surface with the toner 14 because the insulating sheet 2 is formed of polyimide, that is CAPTON™, which is negatively charged through contact with the toner or the toner carry roller 11. This repulsion between the aperture electrode 1 and the toner 14 prevents adherence of the toner to the insulating sheet 2. As a result, the distance between the control electrodes 3 of the aperture electrode 1 and the grounded toner carry roller 11 is prevented from being lengthened by deposition or build up of the toner. Thus, the toner flow can be controlled with a low voltage.

Figure 3:
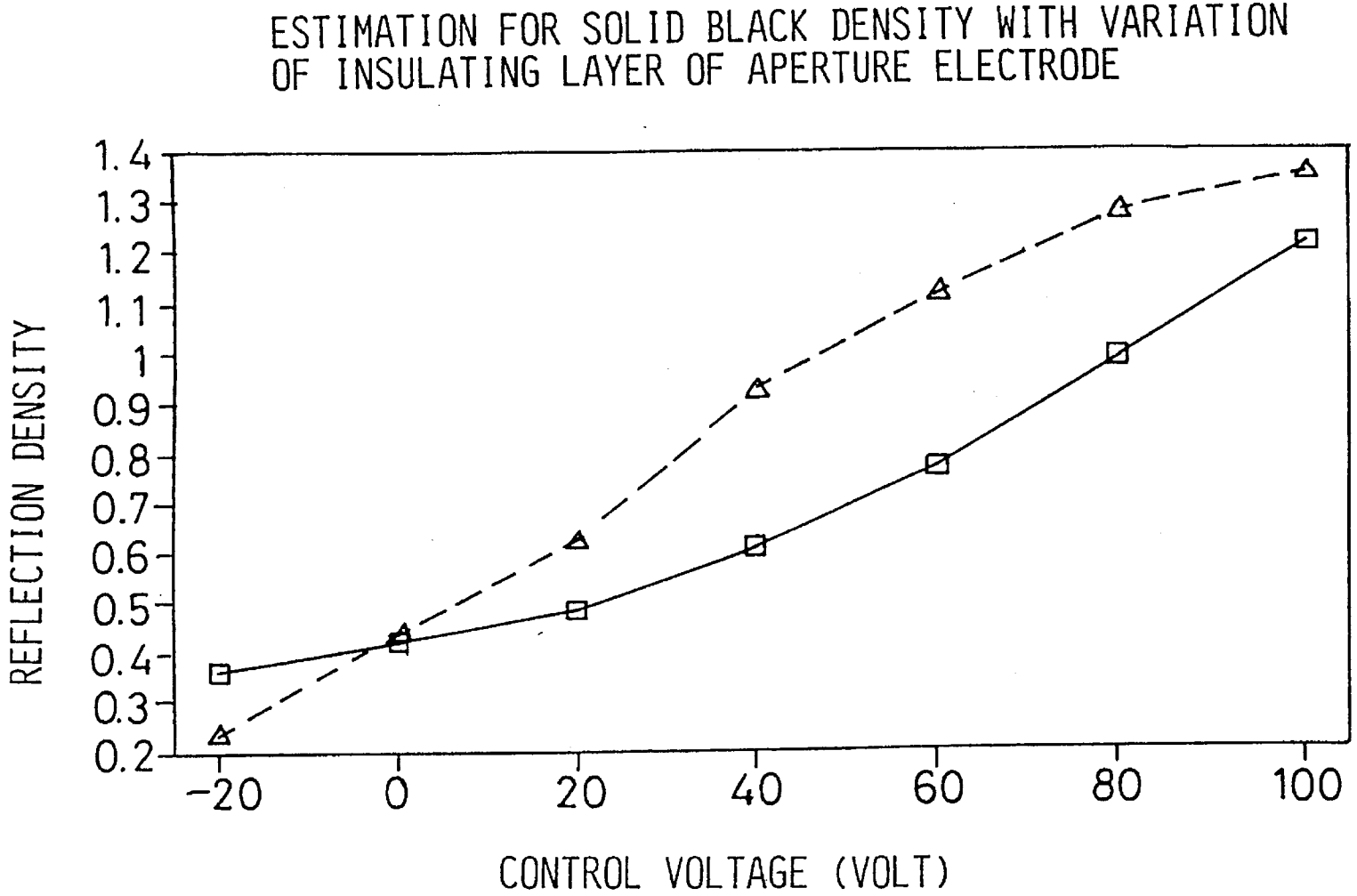
FIG. 3 is a graph showing a recording experiment result using the recording apparatus of the embodiment.

FIG. 3 is a graph showing experimental data for variations of solid black density which is recorded by the control voltage when negatively-chargeable CAPTON™ and positively-chargeable UPILEX™ (a trade name of polyimide produced by UBEKOSAN Co., Ltd.) are used for the insulating sheet 2 of the aperture electrode 1. The chemical formula for UPILEX™ is

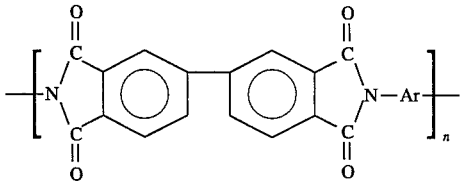

where Ar is an aromatic diamine, preferably 4,4' diaminodicenyl ether or paramine. As is apparent from FIG. 3, the toner flow can be controlled with a lower voltage for CAPTON™ as indicted by a dotted line than UPILEX™ as indicated by a solid line. That is, the passage control of a constant amount of toner through the apertures can be performed with a lower voltage using CAPTON™ than using UPILEX™. The charging of the insulating sheet of the aperture electrode was measured with a surface potentiometer SX-360™ of TREX COMPANY, and CAPTON™ and UPILEX™ were measured as negative surface potential and positive surface potential, respectively.

Figure 9:
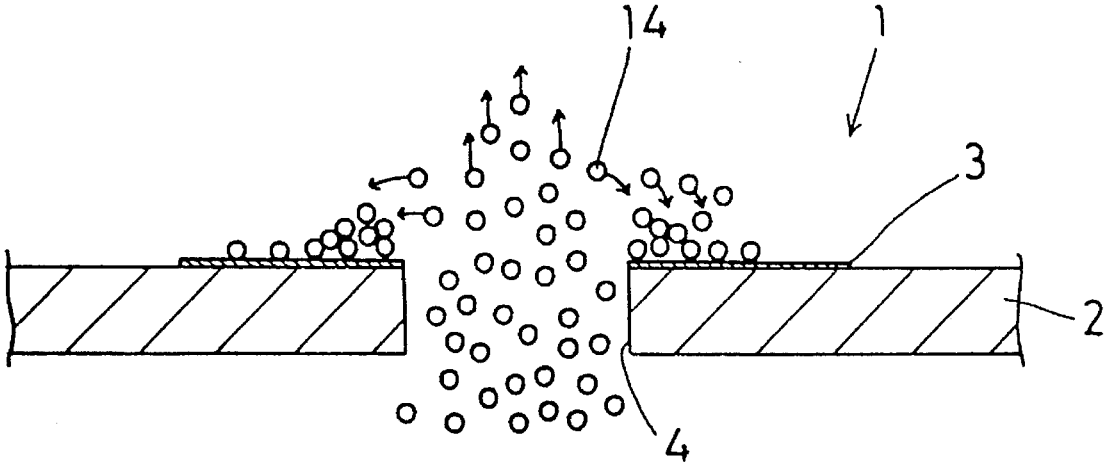
Fig.9 RELATED ART
FIG. 9 is a schematic view showing the operation of a recording apparatus of the related art.

When the toner pass voltage is applied to the control electrodes 3 of the aperture electrode 1, the strongest electric field is formed around the control electrodes 3. As shown in FIG. 9, if a charge member 9 charged in the same polarity as the toner 14 is not provided, all of the toner 14 which passes through the opening portions 4 does not fly toward the back electrode. A part of the toner 14 is electrostatically attracted by the strong electric field and becomes attached to the control electrodes 3. In this embodiment, polyimide CAPTON™ serving as the charge member 9, charged in the same polarity as the toner is provided around the opening portions 4 of the control electrodes 3.

Figure 4:
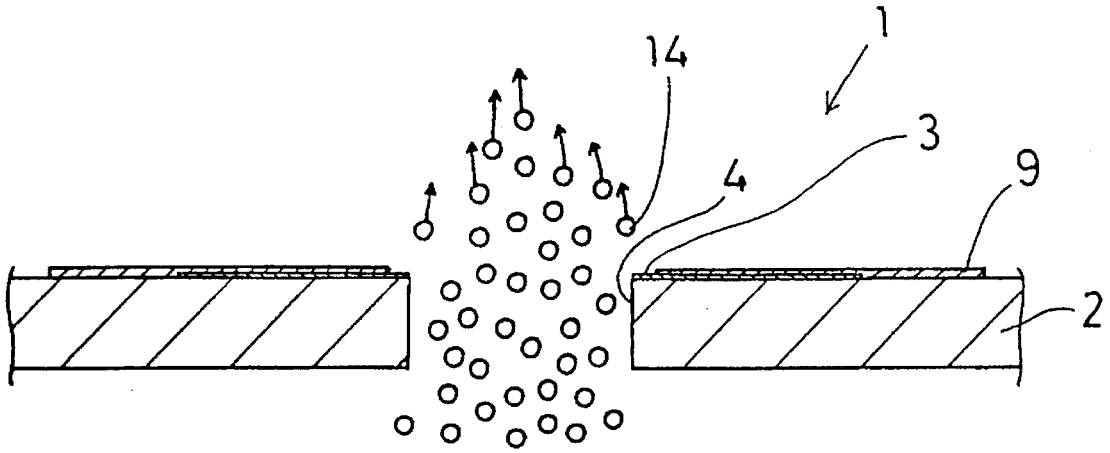
FIG. 4 is a schematic view showing the operation of the recording apparatus of the embodiment.

Accordingly, the toner that passes through the opening portions 4 is attracted to the back electrode by electric field which is formed by a power source connected to the back electrode. The toner 14 is also repulsed from aperture electrode 1 by the repulsive force of the charge member 9. Therefore, as shown in FIG. 4, all of the toner 14 passing through the opening portions 4 flies toward the back electrode. As a result, no toner is attached to the surface of the control electrodes 3 and the stability of recording can be improved.

As previously discussed, the printing medium P inserted through the insertion port 21 into the apparatus is fed to the back electrode 6 by the pair of guide rollers 23. The back electrode 6 is supplied with a voltage of +1.5 kV by the power source 7. An electric field is generated between the back electrode 6 and the aperture electrode 1 by this voltage application. Thus, the toner 14 passed through the opening portions 4 of the aperture electrode 1 is attracted to the back electrode 6 along the electric field. As a result, the toner 14 is coated on the fed printing medium P. The printing medium P is successively fed to form the toner image on the printing medium P.

Thereafter, the printing medium P is fed toward the take-out port. Enroute, it is pinched between the heat roller 24 and the press roller 25 to heat-fix the toner image onto the printing medium P. The printing medium P, on which the toner image is heat-fixed as described above, is fed to the take-out port 22 and discharged therethrough.

As described above, according to this embodiment, the toner 14 which is supplied to the aperture electrode 1 by the toner carry roller 11 is prevented from being attached onto the aperture electrode 1. As a result, a strong toner flow control electric field can be formed with a low control voltage permitting a recording operation to be performed with high image quality. Further, the toner deposition on the control electrodes of the toner flow control means can be prevented thereby providing a recording apparatus capable of performing a stable recording operation at all times.

The invention is not limited to the above embodiment, and various modifications may be made to the embodiment without departing from the subject matter of the invention.

In the above embodiment, the charge polarity of the toner to be supplied to the aperture electrode is set to negative polarity, and the insulating sheet of the aperture electrode and the charge member are formed of CAPTON™, a polyimide which is capable of being negatively charged. However, when positively-chargeable toner is used, the insulating sheet of the aperture electrode and the charge member may be formed of an insulating material which is capable of being positively charged. As the material which is capable of being positively charged, polyimide produced by UBEKOSAN COMPANY, trade name UPILEX, may be used. As described above, various materials may be used for the insulating sheet of the aperture electrode and the charge member in accordance with the charge polarity of the toner, and thus it is not limited to a specific combination.

Further, as shown in a well-known electrification rank, the charge polarity of the insulating sheet of the aperture electrode is varied in accordance with the material of the toner to be contacted with the insulating sheet. Thus, the number of optimum combinations of toner and insulating sheets is infinite. By conducting a plasma treatment on CAPTON™, which is polyimide as described above, to inject positive ions into the surface of polyimide film, the negative charged polarity thereof can be changed to a positive charged polarity. As described above, the charge polarity of the insulating sheet can be easily varied by conducting a surface reforming treatment on the insulating sheet.

Figure 5:
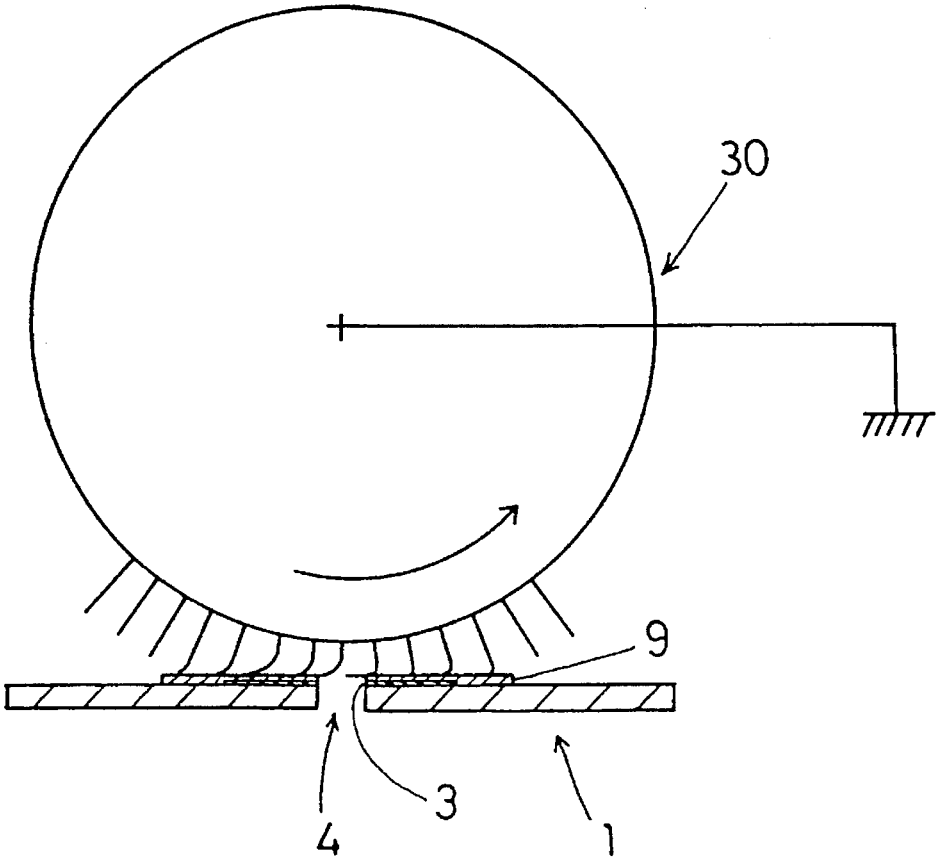
FIG. 5 shows a first modification of the aperture electrode.

Further, in order to keep a predetermined amount of charge in the charge member 9, a member for charging the charge member 9 may be provided. For example, as shown in FIG. 5, a brush 30 is provided adjacent to the charge member 9, and the charge member 9 may be fictionally electrified by the brush 30 at a predetermined time interval.

Figure 6:
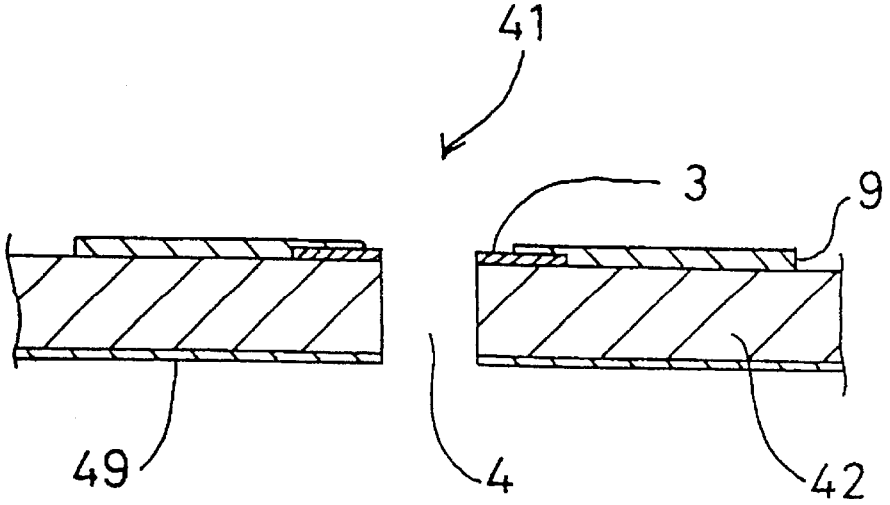
FIG. 6 is a cross-sectional view of a second modification of the aperture electrode.
Figure 7:
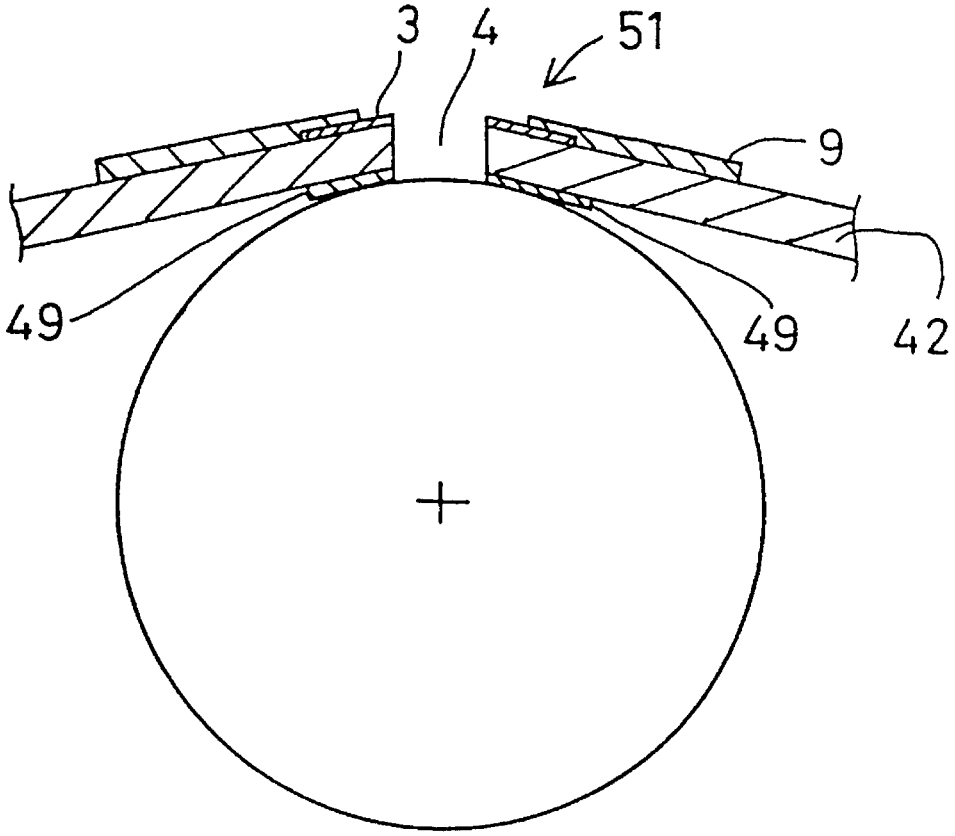
FIG. 7 is a cross-sectional view of a third modification of the aperture electrode.

Still further, as shown in FIG. 6, an aperture electrode 41 having an insulating sheet 42, provided on a coat layer 49 which is liable to be charged in the same polarity as the toner, may be used. Polyimide such as CAPTON™ is more expensive in resin sheets. Accordingly, an inexpensive film, preferably of polyester, PET, nylon or the like is used for an insulating sheet 42, and polyimide is used for an important portion of the insulating sheet 42. Moreover, as shown in FIG. 7, an aperture electrode 51 having a coat layer 49 at only the contact portion with the toner carry roller 11 may be used. In this construction, the minimum amount of coat layer required is sufficient. Thus, the price of the recording apparatus can be lowered.

Figure 8:
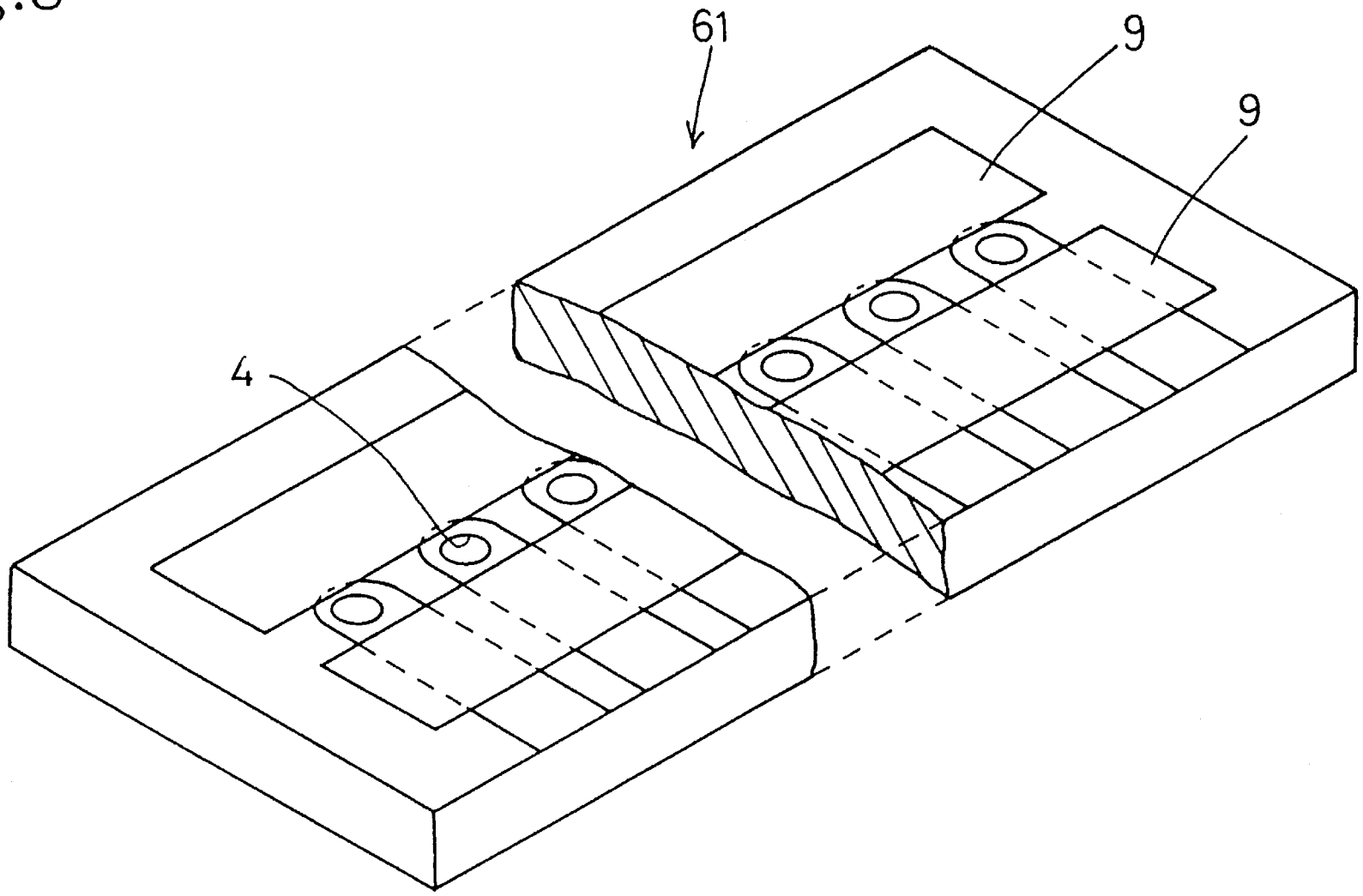
FIG. 8 shows a fourth modification of the aperture electrode.

Still further, as shown in FIG. 8, charge members 9 formed of CAPTON™ may be provided at both sides of a row of opening portions 4 of the aperture electrode 61. In this embodiment, the toner supply device adopts a so-called non-magnetic one-component charging system in which the toner is thin-layered and charged. However, in place of this charging system, a two-component charging system, using a mixture of carrier and toner, or a magnetic one-component charging system using a magneto roller may be used.

Further, in this embodiment, the aperture electrode having opening portions in the insulating sheet is used as the toner flow control means. However, in place of this aperture electrode, a mesh-shaped electrode as described in the specification of U.S. Pat. No. 5,036,341 may be used.

Still further, when the control electrodes are not disposed at the back electrode side, for example when the aperture electrode structure is inverted, material which can be charged in the same polarity as the toner may be used for the insulating layer.

What is claimed is:

1. A recording apparatus, comprising:

a substrate having a plurality of apertures therein;

a back electrode confronting said substrate in such a manner as to permit a recording medium to pass therebetween;

an aperture electrode associated with and surrounding each aperture to provide a plurality of control electrodes, each control electrode disposed to confront said back electrode;

a charge member overlying said plurality of control electrodes; and toner supply means in contact with a side of said substrate opposite to said plurality of control electrodes for supplying charged toner.

2. The recording apparatus as claimed in claim 1, wherein said charge member is charged with the same polarity as the charged toner.

3. The recording apparatus as claimed in claim 1, wherein said substrate and said charge member are made from a same material.

4. The recording apparatus as claimed in claim 3, wherein the material is charged with the same polarity as the charged toner.

5. The recording apparatus as claimed in claim 1, wherein the charge member has a plurality of openings, each opening corresponding to one of said plurality of apertures and each said opening of the charge member is larger than the corresponding aperture of the substrate.

6. The recording apparatus as claimed in claim 1, wherein said substrate has a longitudinal axis, said plurality of apertures aligned at least parallel to the longitudinal axis of said substrate and said charge member comprising an elongated strip overlying said substrate.

7. The recording apparatus as claimed in claim 1, further comprising a rotatable brush, brush elements of said rotatable brush contracting said charge member during rotation.

8. The recording apparatus as claimed in claim 7, wherein rotatable contact by said brush elements with said charge member electrostatically charges said charge member with a same polarity as the charged toner.

* * * * *